US010570864B2

(12) United States Patent
Jovovic et al.

(10) Patent No.: US 10,570,864 B2
(45) Date of Patent: Feb. 25, 2020

(54) FLUID-INJECTION DEVICE FOR INTERNAL COMBUSTION ENGINES

(71) Applicant: Continental Automotive GmbH, Hannover (DE)

(72) Inventors: Dejan Jovovic, Regensburg (DE); Anatoliy Lyubar, Wolfsegg (DE)

(73) Assignee: CONTINENTAL AUTOMOTIVE GMBH, Hannover (DE)

( * ) Notice: Subject to any disclaimer, the term of this patent is extended or adjusted under 35 U.S.C. 154(b) by 0 days.

(21) Appl. No.: 15/766,980

(22) PCT Filed: Oct. 5, 2016

(86) PCT No.: PCT/EP2016/073764

§ 371 (c)(1),
(2) Date: Apr. 9, 2018

(87) PCT Pub. No.: WO2017/060285

PCT Pub. Date: Apr. 13, 2017

(65) Prior Publication Data

US 2018/0306152 A1 Oct. 25, 2018

(30) Foreign Application Priority Data

Oct. 9, 2015 (DE) ..... 10 2015 219 646

(51) Int. Cl.
*F02M 61/12* (2006.01)
*F02M 63/00* (2006.01)
*F02M 61/20* (2006.01)

(52) U.S. Cl.
CPC ..... *F02M 61/12* (2013.01); *F02M 61/20* (2013.01); *F02M 63/0022* (2013.01); *F02M 63/0071* (2013.01); *F02M 2200/26* (2013.01)

(58) Field of Classification Search
CPC ..... F02M 51/0653; F02M 51/0657; F02M 51/0671; F02M 51/0675; F02M 51/0678;
(Continued)

(56) References Cited

U.S. PATENT DOCUMENTS 4,906,109 A 3/1990 Balsells ..... 384/26
5,139,276 A * 8/1992 Balsells ..... F16F 1/04 267/1.5

(Continued)

FOREIGN PATENT DOCUMENTS

DE 19927900 A1 12/2000 ..... F02M 51/06
DE 10024703 A1 11/2001 ..... F02M 47/00

(Continued)

OTHER PUBLICATIONS

German Office Action, Application No. 102015219646.1, 7 pages, dated Sep. 6, 2016.

(Continued)

*Primary Examiner* — Darren W Gorman
(74) *Attorney, Agent, or Firm* — Slayden Grubert Beard PLLC

(57) ABSTRACT

The present disclosure relates to internal combustion engines. Various embodiments of the teaching thereof may include a fluid injection device for internal combustion engines, for example: a valve body with a valve needle; a spring element compressed in a radial direction between the valve body and the valve needle; the spring element supporting the valve needle on the valve body; and the spring element guiding the valve needle to at least substantially prevent tilting of the valve needle relative to the longitudinal axis during operation of the fluid injection device.

14 Claims, 4 Drawing Sheets

(58) Field of Classification Search
CPC .... F02M 51/0682; F02M 61/12; F02M 61/20; F02M 63/0022; F02M 63/0071; F02M 2200/26
USPC ..... 239/533.11, 585.1–585.5
See application file for complete search history.

(56) References Cited

U.S. PATENT DOCUMENTS

| | | | | |
|---|---|---|---|---|
| 5,642,862 | A * | 7/1997 | Wakeman | F02M 51/0671 239/585.4 |
| 6,520,434 | B1 | 2/2003 | Reiter | 239/585.5 |
| 6,695,283 | B2 | 2/2004 | Cotton, III et al. | 251/129.06 |
| 2009/0078798 | A1 * | 3/2009 | Gruendl | F02M 51/0603 239/584 |

FOREIGN PATENT DOCUMENTS

| | | | | |
|---|---|---|---|---|
| DE | 10392756 | T5 | 6/2005 | F02M 51/06 |
| DE | 102008012356 | A1 | 9/2009 | F02M 61/12 |
| EP | 0489377 | A1 | 6/1992 | F16F 1/04 |
| EP | 1431569 | A2 | 6/2004 | F02M 51/06 |
| WO | 2017/060285 | A1 | 4/1917 | F02M 61/12 |

OTHER PUBLICATIONS

International Search Report and Written Opinion, Application No. PCT/EP2016/073764, 15 pages, dated Nov. 30, 2016.

* cited by examiner

FLUID-INJECTION DEVICE FOR INTERNAL COMBUSTION ENGINES

CROSS-REFERENCE TO RELATED APPLICATIONS

This application is a U.S. National Stage Application of International Application No. PCT/EP2016/073764 filed Oct. 5, 2016, which designates the United States of America, and claims priority to DE Application No. 10 2015 219 646.1 filed Oct. 9, 2015, the contents of which are hereby incorporated by reference in their entirety.

TECHNICAL FIELD

The present disclosure relates to internal combustion engines. Various embodiments of the teaching thereof may include a fluid injection device for internal combustion engines, for example for the direct injection of fuel in auto-ignition internal combustion engines.

BACKGROUND

DE 100 24 703 A1 has disclosed a fuel injection valve in the case of which the valve needle is, in a central section, guided with very little play in the pressure chamber. To permit a passage of fuel, lateral ground portions are provided on the valve needle. In the case of such a structural form, the components, in particular the valve needle and the pressure chamber, must be machined in a very precise manner, which leads to increased production costs, because the machining of the inner side of a bore always involves great effort. Precise guidance of the valve needle is sought to achieve high accuracy in the dosing of the fuel and a symmetrical atomization of the fuel. Furthermore, precise guidance of the valve needle reduces the wear on the valve seat.

SUMMARY

The teachings of the present disclosure enable a fluid injection device for internal combustion engines which exhibits precise guidance of the valve needle but is at the same time robust and inexpensive. For example, a fluid injection device (1) for internal combustion engines may include: a valve body (13) in which a valve needle (5) is arranged so as to be displaceable along a longitudinal axis (34) of the valve body (13) and interacts with a valve seat (9) in order to open up or close off a fluid outlet. The fluid injection device (1) has at least one spring element (17) which is arranged in a radial direction between the valve body (13) and the valve needle (5) and by means of which the valve needle (5) is supported on the valve body (13), such that the valve needle (5) is guided by means of the spring element (17) in order to at least substantially prevent tilting of the valve needle (5) relative to the longitudinal axis (34) during the operation of the fluid injection device (1).

In some embodiments, the spring element (17) is arranged in a radial direction between the valve needle (5) and a side wall (14), encircling the longitudinal axis (34), of the valve body (13) and bridges the radial gap (16) between the valve needle (5) and the side wall (14).

In some embodiments, the valve needle (5) is centered with respect to the longitudinal axis (34), and axially guided, by means of the spring element.

In some embodiments, the at least one spring element (17) is preloaded in a radial direction.

In some embodiments, at opposite sides of the gap (16), the spring element (17) exerts oppositely directed radial forces on the valve needle (5) and on the valve body.

In some embodiments, the at least one spring element (17) is formed as a circular helical spring with a closed, curved central line about which the windings of the helical spring are wound, and the valve needle (5) is supported by means of the spring element (17) on the valve body (13) by virtue of the spring element (17) being supported with its inner circumference on the valve needle (5) and with its outer circumference on the valve body (13).

In some embodiments, the at least one spring element (17) is formed as a spider-type spring and has an inner circumference (35), by means of which it is supported on the valve needle (5), and a number of spring legs (36), by means of which it is supported on the valve body (13).

In some embodiments, there is a multiplicity of spring elements (17) as a guide of the valve needle (5), which spring elements are arranged in a radial direction between the valve body (13) and the valve needle (5) and by means of which spring elements the valve needle (5) is supported on the valve body (13), wherein at least two of the spring elements (17) are formed as helical springs and are arranged, spaced apart from one another along the circumference of the valve needle (5), between the valve needle (5) and the valve body (13).

In some embodiments, there is a multiplicity of spring elements (17) as a guide of the valve needle (5), which spring elements are arranged in a radial direction between the valve body (13) and the valve needle (5) and by means of which spring elements the valve needle (5) is supported on the valve body (13), wherein at least a first spring element (17) is arranged on a section of the valve needle (5) facing toward the fluid outlet, and at least a second spring element (17) is arranged on a section of the valve needle (5) remote from the fluid outlet.

In some embodiments, the spring element (17) or at least one of the spring elements (17) is arranged on a central section of the valve needle (5) between a section of the valve needle (5) facing toward the fluid outlet and a section of the valve needle (5) remote from the fluid outlet.

In some embodiments, the at least one spring element (17) is welded to the valve needle (5) and/or to an inner surface of the valve body (13).

In some embodiments, the at least one spring element (17) is formed from a corrosion-resistant spring steel.

BRIEF DESCRIPTION OF THE DRAWINGS

The teachings of the present disclosure will be discussed in more detail below on the basis of exemplary embodiments and with reference to the appended schematic drawings.

DETAILED DESCRIPTION

Figure 1:
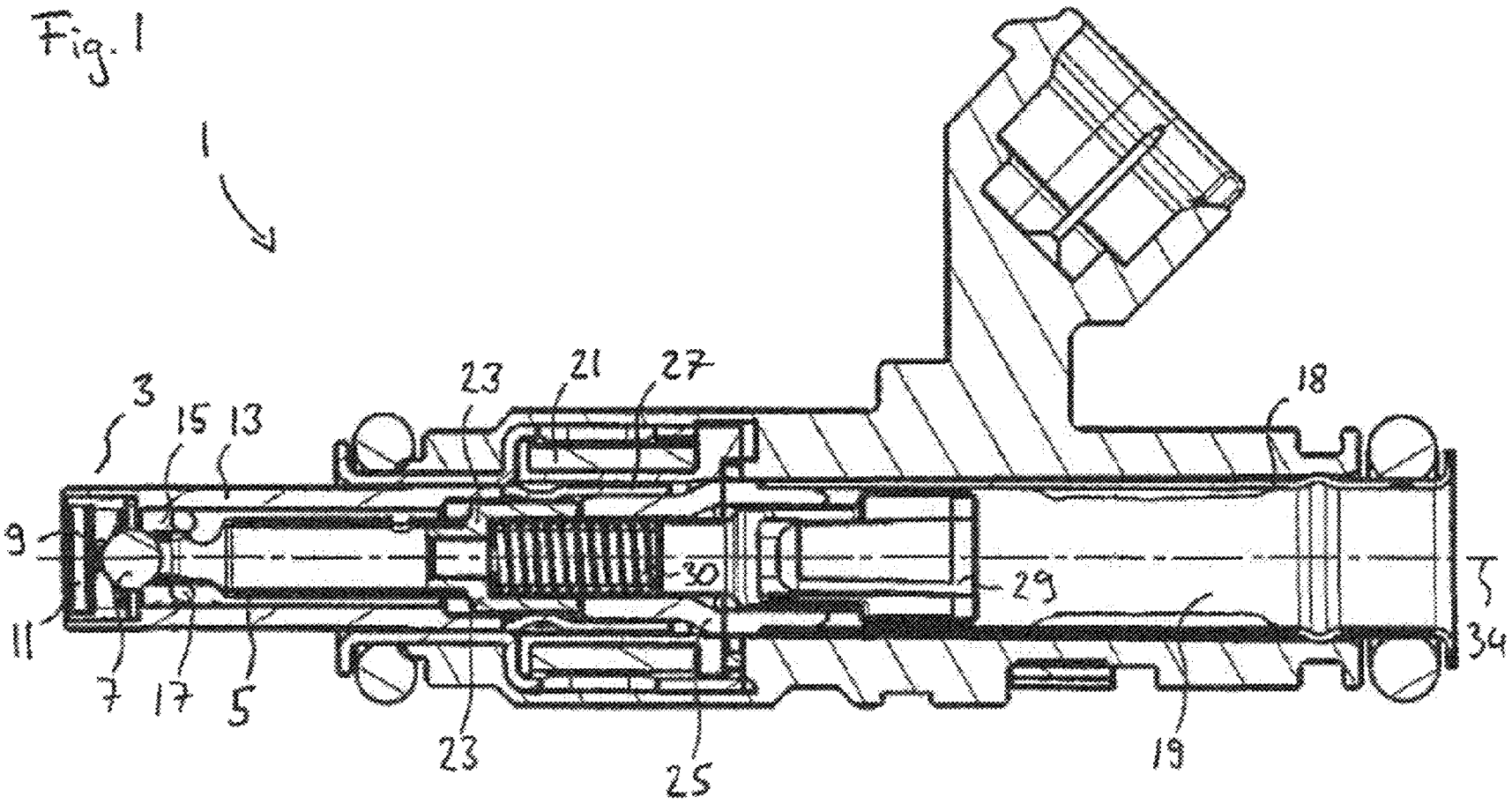
FIG. 1 shows a longitudinal section through a fluid injection device according to teachings of the present disclosure.

Some embodiments may include a fluid injection device for internal combustion engines is specified, in particular a fluid injector. The fluid injection device is for example a fuel injection device, in particular a fuel injector.

In some embodiments, the fluid injection device has a valve body in which a valve needle is arranged so as to be displaceable along a longitudinal axis of the valve body and which interacts with a valve seat in order to open up or close off a fluid outlet. In the case of a fuel injection device, the fluid outlet is a fuel outlet. The fluid injection device has at least one spring element as a guide of the valve needle, which at least one spring element is arranged between the valve body and the valve needle and by means of which at least one spring element the valve needle is supported on the valve body.

In some embodiments, the spring element is arranged in a radial direction between the valve needle and an encircling side wall of the valve body. In some embodiments, the spring element bridges the radial gap between the valve needle and the side wall. The encircling side wall delimits the cavity of the valve body, through which fluid flows from an inlet of the fluid injector to the fluid outlet and in which the valve needle is arranged, specifically in particular in a radial direction.

The spring element may be compressible in a radial direction. The statement that the spring element constitutes a guide of the valve needle is to be understood to mean that the spring element prevents or at least substantially prevents tilting of the valve needle relative to the longitudinal axis during the operation of the fluid injection device. The valve needle is preferably centered with respect to the longitudinal axis, and axially guided, by means of the spring element.

The valve needle is accordingly not guided directly by rigid bodies, and is not guided directly by housing parts, it rather being the case that at least one spring element, which is in turn connected to the valve body, serves for the guidance.

This has the advantage that particularly high accuracy in the production of the components is not necessary. The needle does not need to be guided in a play-free manner. Rather, the at least one spring element transmits guide forces—e.g. radially directed guide forces—between the valve needle and the valve body. If the spring element is designed such that said guide forces are symmetrical, precise guidance of the valve needle is possible.

This solution is relatively inexpensive owing to the play of the components. Furthermore, the feed of fuel to the fluid outlet does not pose any problems. In some embodiments, by means of the spring element, a particularly large hydraulic diameter of the cavity of the valve body in the region of the guide can be realized. In this way, greater design freedom is also achieved with regard to the fluid injection device. In some embodiments, it is for example possible to dispense with the formation of axial fluid ducts in the region of the guide—for example by means of flattened portions of the valve needle or of the side wall of the valve body.

Here, and below, a valve body is to be understood to mean a housing part or a component fixedly connected to a housing part of the fluid injection device, which housing part or component surrounds the fluid-filled interior space in the lower region of the fluid injection device—which is in particular the cavity of the valve body—and on which the valve needle is guided.

Here, and below, support of the valve needle on the valve body by means of the spring element is to be understood to mean that a transmission of force from the valve needle to the valve body and vice versa is possible by means of the spring element. In some embodiments, the spring element exerts restoring forces on the valve needle, which restoring forces effect centering guidance of the valve needle. The restoring forces expediently act in a radial direction on the valve needle. At the same time, the spring element exerts forces on the valve body, e.g. on the side wall thereof, which forces are opposed to the radial restoring forces. If the valve needle moves for the purposes of opening or closing the fluid outlet, it is possible, in one embodiment, for the spring element to additionally exert axial restoring forces on the valve needle.

In some embodiments, the at least one spring element has a preload, specifically in the fully assembled state of the fluid injection device and regardless of the setting of the valve, that is to say of the position of the valve needle. In some embodiments, the spring element is preloaded in a radial direction. For example, it is braced, to be compressed in a radial direction, in the radial gap between the valve needle and the side wall of the valve body.

This provides a symmetrical restoring force and reliable guidance of the valve needle can be achieved. The preload also prevents radial play from forming between the spring and the valve body or the valve needle over the course of time, which would prevent reliable guidance of the valve needle.

In some embodiments, the at least one spring element is formed as a circular helical spring and is supported with its inner circumference on the valve needle and with its outer circumference on the valve body.

In some embodiments, the spring element has the outer contours of a torus, which is formed by a helical spring. In other words, the helical spring has a torus as an envelope. The windings of the helical spring may expediently be wound around a curved and closed central line—e.g. a circular central line—the central line of the torus. Here, the central line is expediently only an imaginary line. Such a spring element is suitable for exerting a symmetrical restoring force on the valve needle and thus effecting reliable guidance.

In some embodiments, the at least one spring element is formed as a spider-type spring. The spider-type spring has an inner circumference, with which it is supported on the valve needle, and a number of spring legs, with which it is supported on the valve body. Here, a spider-type spring is to be understood to mean a spring with a ring-shaped main body and with a multiplicity of spring legs which extend radially outward from the main body. The main body may have a passage, a central opening, which defines the inner circumference and through which the valve needle extends. The spring legs may be curved, such that, in particular, they extend not only radially outward from the main body but at the same time axially beyond the main body. Such a spring element is also suitable for effecting a symmetrical restoring force and thus reliable guidance of the valve needle. It can be installed particularly easily.

In some embodiments, at least two spring elements are provided, which are formed as helical springs and which are arranged, so as to be spaced apart from one another along the circumference of the valve needle, to be situated opposite one another, between the valve needle and the valve body.

In some embodiments, the degree of the symmetry of the forces acting on the valve needle can be increased by virtue of a greater number of spring elements being arranged along the circumference of the valve needle, for example 3, 4, 5 or 6 spring elements, which may be distributed symmetrically in the circumferential direction. In this way, guidance of the valve needle can be realized by means of components of particularly simple form.

Fuel can pass through both a helical spring and a spider-type spring without problems. A particularly large hydraulic diameter can be achieved, such that no further means are necessary for a passage of fuel through the interior space of the fluid injection device.

In some embodiments, at least one first spring element is arranged on a section of the valve needle facing toward the fluid outlet, and at least one second spring element is arranged in a section of the valve needle remote from the fluid outlet. In some embodiments, the first and the second spring element are adjacent to opposite axial ends of the valve needle.

In some embodiments, guidance of the valve needle is provided at at least two points, specifically at the top and at the bottom on the valve needle. The guidance is thus particularly stable. The risk of tilting of the valve needle is particularly low. For example, a first circular helical spring may be provided on a section of the valve needle facing toward the fluid outlet, and a second circular helical spring may be provided on a section of the valve needle remote from the fluid outlet. It is however also possible for different types of spring elements to be used, for example a circular helical spring on a section of the valve needle facing toward the fluid outlet and a spider-type spring on a section of the valve needle remote from the fluid outlet.

In some embodiments, at least one spring element is arranged on a central section of the valve needle between a section of the valve needle facing toward the fluid outlet and a section of the valve needle remote from the fluid outlet. In some embodiments, the geometrical center of gravity of the spring element is arranged offset with respect to the geometrical center of gravity of the valve needle in an axial direction by 30% or less, or even by 20% or less, of the axial extent of the valve needle. Said spring element makes it possible to realize a guide of the valve needle in the central section, such that particularly exact axial guidance of the valve needle can be achieved.

Said guide may be provided as the only guide of the valve needle, in particular if a guide of the valve needle is realized in any case in another section by means of the geometry of the fluid injection device, for example at the valve seat. The guide in the central section of the valve needle may however also be provided in addition to a guide on a section of the valve needle facing toward the fluid outlet and on a section of the valve needle remote from the fluid outlet.

In some embodiments, the at least one spring element may be welded, or fixedly connected in some other way, to an outer wall of the valve needle and/or to an inner wall of the valve body. For example, a circular helical spring may be welded at its inner circumference to the valve needle and/or at its outer circumference to the valve body. A spider-type spring may be welded at its inner circumference to the valve needle and/or at its spring legs to the valve body. The at least one spring element may however also be welded only to the valve needle or to the valve body, and slide along the valve body or the valve needle respectively.

In some embodiments, the at least one spring element is formed from a corrosion-resistant spring steel, wherein the corrosion resistance relates to the fuel used, with which the spring element is in contact.

FIG. 1 shows a fluid injection device 1 according to teachings of the present disclosure. The present fluid injection device 1 comprises a fuel injector, in particular for injecting fuel into the intake tract of an internal combustion engine. It may alternatively also be a urea injector for injecting a urea solution for exhaust-gas aftertreatment.

The fluid injection device 1 has a valve 3 with a valve needle 5, with a tip 7 designed as a ball and with a valve seat 9. In the closed state, the tip 7 is pressed onto the valve seat 9 by the force of a restoring spring 30 and thus closes off the nozzle 11. A valve housing—the valve body 13—surrounds the valve 3 and the nozzle shaft 15, which is formed as a cavity within the valve body 13 and which is filled with fuel during operation. The nozzle 11 forms a fluid outlet of the fluid injection device 1, that is to say in the present case for example a fuel outlet.

An inlet chamber 19, which is formed by the inlet tube 18 and which has a flow connection to the nozzle shaft 15, adjoins the nozzle shaft 15 on that side of the latter which faces away from the fluid outlet. Arranged in the inlet chamber 19 is a filter 29 for the fuel, by means of the positioning of which filter the preload of the restoring spring 30 can be set.

During operation, the inlet chamber 19 and the nozzle shaft 15 are filled with the fuel for injection. To permit an injection of the fuel through the nozzle 11, the fluid injection device 1 has an electromagnetic actuation device.

The electromagnetic actuation device comprises a coil 21, an armature 23, a pole piece 25, and a nonmagnetic sleeve 27, which is press-fitted onto one end of the pole piece 25. The armature 23 is displaceable in a longitudinal direction of the fluid injection device 1 and, in the present case, is fixedly connected to the valve needle 5. Said armature, when it moves axially, thus drives the valve needle 5 along. In the event of a displacement in a direction away from the valve seat 9, the valve needle 5 opens up the nozzle 11 and thereby permits the discharge of fluid—that is to say in the present case for example fuel or urea solution—through the nozzle 11.

The fluid injection device 1 guides of the valve needle 5 by means of a spring element 17 which is arranged within the nozzle shaft 15. In the embodiment shown, the spring element 17 is formed as a circular helical spring, the windings of which are wound around a closed imaginary central line which runs in circular encircling fashion about the longitudinal axis 34.

Figure 2A:
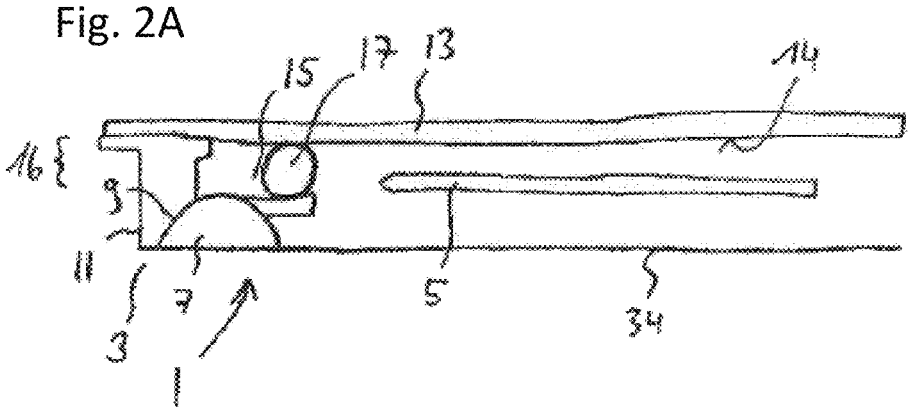
FIG. 2A shows a detail of the fluid injection device as per FIG. 1.

FIG. 2A shows a detail of the fluid injection device 1 with the spring element 17 in detail. Here, for the sake of simplicity, only the half of the fluid injection device 1 above the longitudinal axis 34 is shown. In the expanded state, the overall diameter of the spring element 17 is slightly larger than the diameter of the nozzle shaft 15, such that said spring element can be inserted into the nozzle shaft 15 with a slight preload.

The internal diameter of said spring element may, in the expanded state, be slightly smaller than the external diameter of the valve needle 5, such that said spring element is also preloaded relative to the valve needle 5. The spring element 17, after being inserted into the nozzle shaft 15, is arranged in the radial gap 16 between the valve needle 5 and a side wall 14, running in encircling fashion around the longitudinal axis 34, of the valve body 13. Said spring element is supported with its inner circumference on the valve needle 5 and with its outer circumference on the valve body 13. Said spring element thus bridges the radial gap between the valve needle 5 and the valve body 13 and exerts radially inwardly directed restoring forces on the valve needle 5. Correspondingly, the spring element 17 exerts radially outwardly directed opposing forces on the side wall 14 of the valve body 13 in the region of the nozzle shaft. By means of the restoring forces, the valve needle 5 is centered on the longitudinal axis 34 and guided axially by means of the spring element 17 in the region of the nozzle shaft 15.

In the first embodiment shown in FIGS. 1 and 2A, only one circular helical spring is provided as a guide of the valve needle 5. Said spring element 17 is arranged in a section of the valve needle facing toward the fluid outlet, specifically in the axial end region of the valve needle 5 directly in front of the tip 7.

Further guides of the valve needle by means of spring elements 17 are not illustrated in FIGS. 1 and 2A. For example, that end of the valve needle 5 which is averted from the tip 7 is however axially guided by means of the armature 23. For this purpose, the armature 23 may be in sliding contact with the sleeve 27 and/or with the valve body 3.

Figure 2B:
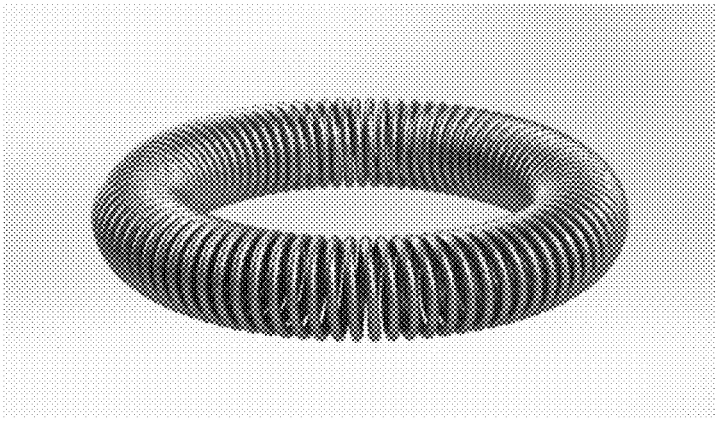
FIG. 2B shows a three-dimensional view of the example circular helical spring element shown in FIGS. 1 and 2A.

FIG. 2B shows a three-dimensional view of the example circular helical spring 17 of FIGS. 1 and 2A, according to one embodiment.

Figure 3A:
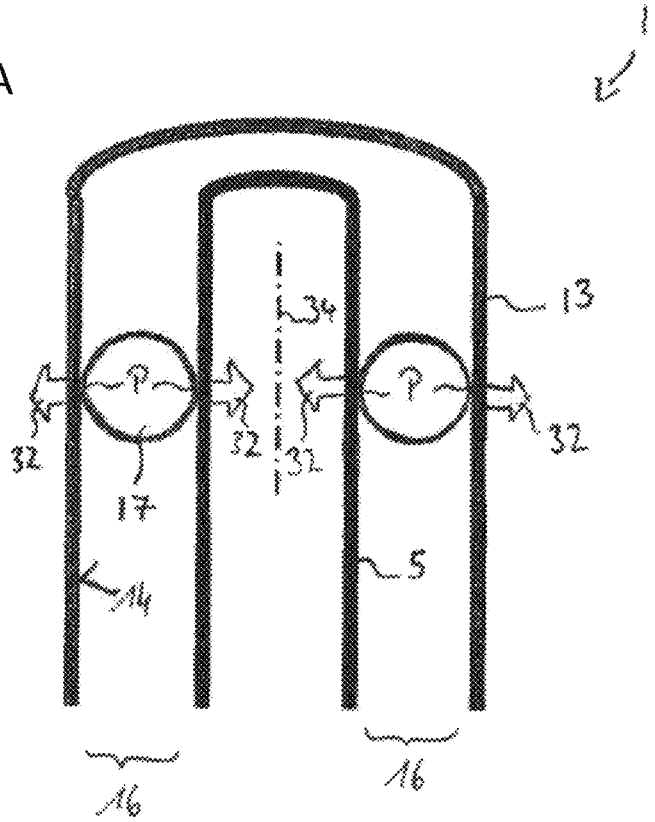
FIG. 3A shows a detail of a fluid injection device including a single spring element according to teachings of the present disclosure.

FIG. 3A shows a diagrammatic sketch of a detail of a fluid injection device 1 according to teachings of the present disclosure, which could be combined with the first embodiment as per FIGS. 1 and 2A. As shown, a spring element 17 is arranged on a section of the valve needle 5 remote from the fluid outlet. In some embodiments, the spring element 17 is likewise formed as a circular helical spring. The latter is welded to the valve needle 5 and to the valve body 13 at points denoted by P. Such welding of the spring element 17 may also be provided in the embodiment shown in FIGS. 1 and 2A, but, for the sake of clarity, is not illustrated.

The spring element 17 is inserted under preload into the valve body 13. Said spring element therefore exerts radial forces, indicated by the arrows 32, on the valve needle 5 and on the side wall 14 of the valve body 13. Said forces effect axial guidance of the valve needle 5 in the valve body 13, and center the valve needle 5 on the longitudinal axis 34.

Figure 3B:
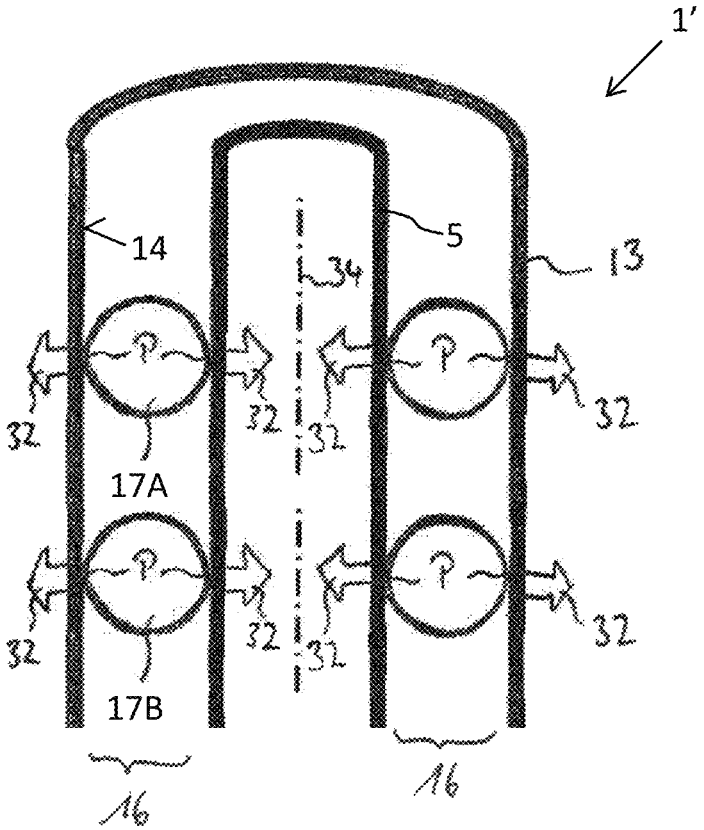
FIG. 3B shows a detail of a fluid injection device including multiple spring elements arranged along the valve needle according to teachings of the present disclosure.

FIG. 3B shows a diagrammatic sketch of a detail of a fluid injection device 1' according to teachings of the present disclosure, which is similar to the device shown in FIG. 3A, but including multiple spring elements 17A and 17B arranged spaced apart from each other along the valve needle 5, according to one embodiment.

Figure 4:
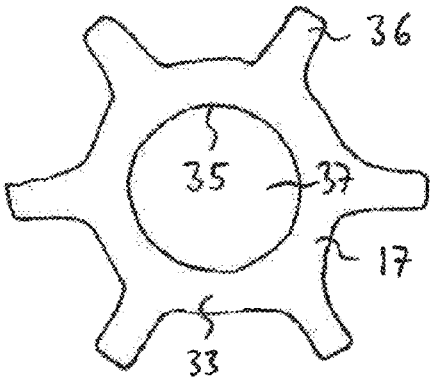
FIG. 4 shows a spring element for a fluid injection device according to teachings of the present disclosure.

FIG. 4 shows, in a plan view along the longitudinal axis 34, a spring element 17 according to teachings of the present disclosure. In the embodiment shown, the spring element 17 is formed as a spider-type spring and has a ring-shaped main body 33 with an inner circumference 35 which surrounds a passage 37. Spring legs 36 extend outward from the ring-shaped main body 33. Furthermore, the spring legs 36 are curved such that they extend away from the main body 33 in the axial direction and project axially beyond said main body. In the present case, the spring legs 36 have a C-shaped curved profile (see FIG. 5).

Figure 5:
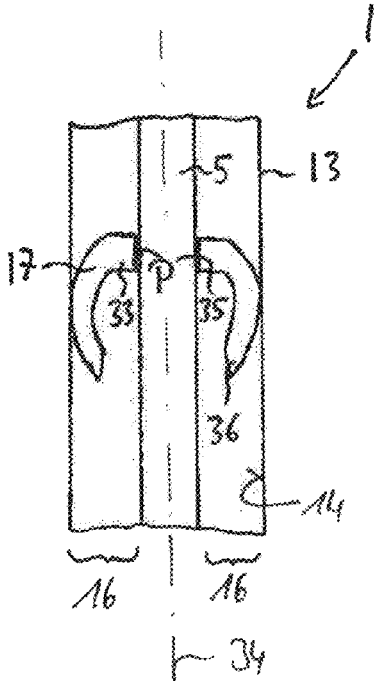
FIG. 5 shows a longitudinal section through a detail of a fluid injection device having the spring element as per FIG. 4.

FIG. 5 shows a fluid injection device 1 with the spring element 17 shown in FIG. 4. The spring element 17 is arranged such that the valve needle 5 extends through the passage 37 and the inner circumference 35 of the spring element 17 bears against the valve needle 5. Along the inner circumference 35, the spring element 17 is welded to the valve needle 5.

With its spring legs 36, the spring element 17 is supported on the valve body 13. Since the spring element 17 is inserted under preload into the valve body 13, it exerts forces on the valve body 13 and on the valve needle 5 in the manner discussed with regard to FIG. 3A, which forces effect guidance of the valve needle 5. For example, owing to the elasticity of the spring elements 17, the valve needle may be movable along the longitudinal axis 34 to the extent required for the opening and closing of the valve.

The various embodiments shown may be combined with one another. For example, spring elements 17 in the form of circular helical springs and in the form of spider-type springs, or spring elements of other design, may be combined with one another, such that one of the spring elements 17 is arranged on a section of the nozzle needle 5 facing toward the fluid outlet and at least one further, differently designed spring element 17 is arranged on a section of the nozzle needle 5 situated remote from the fluid outlet.

What is claimed is:

1. A fluid injection device for internal combustion engines, the device comprising:

a valve body with a valve needle arranged therein so as to be displaceable along a longitudinal axis of the valve body;

wherein the valve needle interacts with a valve seat to open up or close off a fluid outlet;

a spider-type spring element compressed in a radial direction between the valve body and the valve needle, wherein the spider-type spring element comprises:

a ring-shaped main body extending around a circumference of the valve needle; and a plurality of spring legs extending radially outwardly from the main body and extending axially away from the main body, each spring leg imparting a radial force on an interior sidewall of the valve body;

the spring element supporting the valve needle on the valve body;

the spring element guiding the valve needle to at least substantially prevent tilting of the valve needle relative to the longitudinal axis during operation of the fluid injection device.

2. The fluid injection device as claimed in claim 1, wherein the spring element is compressed in a radial direction between the valve needle and a side wall of the valve body and bridges a radial gap between the valve needle and the side wall.

3. The fluid injection device as claimed in claim 1, wherein the valve needle is both centered with respect to the longitudinal axis and axially guided by the spring element.

4. The fluid injection device as claimed in claim 1, wherein the spring element is preloaded in a radial direction.

5. The fluid injection device as claimed in claim 2, wherein, at opposite sides of the gap, the spring element exerts oppositely directed radial forces on the valve needle and on the valve body.

6. The fluid injection device as claimed in claim 1, wherein each spring leg of the spider-type spring element contacts the interior sidewall of the valve body at a location axially offset from an axial location of the ring-shaped main body.

7. The fluid injection device as claimed in claim 1, comprising a multiplicity of spring elements, including the spring element, guiding the valve needle;

wherein the multiplicity of spring elements are arranged in a radial direction between the valve body and the valve needle supporting the valve needle on the valve body;

at least two of the spring elements comprise helical springs and are arranged, spaced apart from one another along the circumference of the valve needle between the valve needle and the valve body.

8. The fluid injection device as claimed in claim 1, comprising a multiplicity of spring elements, including at least the spring element and a further spring element, guiding the valve needle;

wherein the spring elements are arranged in a radial direction between the valve body and the valve needle and to support the valve needle on the valve body;

wherein at least the spring element is arranged on a section of the valve needle facing toward the fluid outlet; and at least the further spring element is arranged on a section of the valve needle remote from the fluid outlet.

9. The fluid injection device as claimed in claim 1, wherein the spring element is arranged on a central section of the valve needle between a section of the valve needle facing toward the fluid outlet and a section of the valve needle remote from the fluid outlet.

10. The fluid injection device as claimed in claim 1, wherein the spring element is welded to the valve needle and/or to an inner surface of the valve body.

11. The fluid injection device as claimed in claim 1, wherein the spring element comprises a corrosion-resistant spring steel.

12. The fluid injection device as claimed in claim 1, wherein each spring leg of the spider-type spring element has a free end located axially away from the ring-shaped main body.

13. The fluid injection device as claimed in claim 1, wherein each spring leg of the spider-type spring element has a C-shaped curved profile in a respective longitudinal cross-sectional plane that contains the longitudinal axis of the valve body.

14. A fluid injection device for internal combustion engines, the device comprising:

a valve body with a valve needle arranged therein so as to be displaceable along a longitudinal axis of the valve body;

wherein the valve needle interacts with a valve seat to open up or close off a fluid outlet;

a spring element compressed in a radial direction between the valve body and the valve needle, wherein the spring element comprises a circular helical spring with a closed, curved central line about which the windings of the helical spring are wound;

wherein the valve needle is supported on the valve body by the spring element by virtue of wherein the spring element has an inner circumference supported on the valve needle and an outer circumference supported on the valve body to thereby align the valve needle radially relative to the valve body;

wherein the spring element guides the valve needle to at least substantially prevent tilting of the valve needle relative to the longitudinal axis during operation of the fluid injection device; and wherein the spring element is physically unrestricted in an at least one axial direction such that the spring element is axially movable relative to the valve body during axial movement of the valve needle, while maintaining a radial alignment of the valve needle relative to the valve body.

* * * * *